US008918003B2

(12) United States Patent
Kawai et al.

(10) Patent No.: US 8,918,003 B2
(45) Date of Patent: Dec. 23, 2014

(54) FIXING DEVICE

(71) Applicant: Canon Kabushiki Kaisha, Tokyo (JP)

(72) Inventors: Hiroki Kawai, Toride (JP); Oki Kitagawa, Kashiwa (JP); Shigeaki Takada, Abiko (JP); Akiyoshi Shinagawa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 34 days.

(21) Appl. No.: 13/718,331

(22) Filed: Dec. 18, 2012

(65) Prior Publication Data

US 2013/0164015 A1 Jun. 27, 2013

(30) Foreign Application Priority Data

Dec. 22, 2011 (JP) ..... 2011-281151

(51) Int. Cl.
*G03G 15/20* (2006.01)
*G03G 15/00* (2006.01)

(52) U.S. Cl.
CPC .. *G03G 15/2039* (2013.01); *G03G 2215/00751* (2013.01); *G03G 15/5029* (2013.01)
USPC ..... 399/69

(58) Field of Classification Search
CPC ..... G03G 15/2017
USPC ..... 399/45, 69
See application file for complete search history.

(56) References Cited

U.S. PATENT DOCUMENTS

| | | | | |
|---|---|---|---|---|
| 7,079,802 | B2 * | 7/2006 | Katayanagi et al. | 399/331 |
| 7,200,354 | B2 | 4/2007 | Nakamoto et al. | |
| 7,457,576 | B2 | 11/2008 | Takada et al. | |
| 7,466,950 | B2 | 12/2008 | Matsuura et al. | |
| 7,596,348 | B2 | 9/2009 | Nakamoto et al. | |
| 7,844,208 | B2 | 11/2010 | Hayashi et al. | |
| 8,208,833 | B2 | 6/2012 | Kitagawa | |
| 8,301,067 | B2 | 10/2012 | Takada | |
| 2009/0060540 | A1 * | 3/2009 | Matsushita et al. | 399/45 |
| 2012/0003346 | A1 | 1/2012 | Chigono et al. | |
| 2012/0027444 | A1 | 2/2012 | Kitagawa | |
| 2012/0155940 | A1 | 6/2012 | Hagiwara et al. | |
| 2012/0251153 | A1 | 10/2012 | Takada | |
| 2013/0034361 | A1 | 2/2013 | Shinagawa | |
| 2013/0034362 | A1 | 2/2013 | Matsuura et al. | |
| 2013/0051831 | A1 | 2/2013 | Shinagawa et al. | |
| 2013/0058672 | A1 | 3/2013 | Takada et al. | |
| 2013/0129364 | A1 * | 5/2013 | Kitagawa et al. | 399/21 |
| 2013/0142532 | A1 * | 6/2013 | Kitagawa et al. | 399/67 |
| 2013/0206745 | A1 * | 8/2013 | Tanaka et al. | 219/469 |

FOREIGN PATENT DOCUMENTS

JP 2010-54526 A 3/2010

* cited by examiner

*Primary Examiner* — Gregory H Curran
(74) *Attorney, Agent, or Firm* — Fitzpatrick, Cella, Harper & Scinto

(57) ABSTRACT

A fixing device includes: a rotatable fixing member configured to fix at a nip a toner image formed on recording paper; a rotatable pressing member configured to form the nip between itself and the rotatable fixing member; and a controller configured to control a temperature of the rotatable pressing member depending on smoothness of the recording paper.

19 Claims, 9 Drawing Sheets

PRINT

| MATERIAL | BSS WGT ($g/m^2$) | TRGT TEMP. | | JOB START TEMP. | |
|---|---|---|---|---|---|
| | | FXNG RLR | PRSNG RLR | FXNG RLR | PRSNG RLR |
| T.P.2 | 181~256 | 190°C | 100°C | 190°C | 100°C～120°C |
| T.P.1 | 106~180 | 185°C | 100°C | 185°C | 100°C～120°C |
| P.P.2 | 91~105 | 180°C | 100°C | 180°C | 100°C～120°C |
| P.P.1 | 64~90 | 175°C | 100°C | 175°C | 100°C～120°C |
| THN PPR | 52~63 | 165°C | 100°C | 165°C | 100°C～120°C |
| CTD PPR | 106~180 | 170°C | 100°C | 170°C | 100°C～110°C |

STAND-BY

| TRGT TEMP. | |
|---|---|
| FXNG RLR | PRSNG RLR |
| 180°C | 100°C |

FIXING DEVICE

FIELD OF THE INVENTION AND RELATED ART

The present invention relates to a fixing device (image heating apparatus) for fixing a toner image formed on a recording paper. This fixing device is used in an image forming apparatus of an electrophotographic type, such as a copying machine, a printer, a facsimile machine or a multi-function machine having a plurality of functions of these machines.

In recent years, the image forming apparatus is required to accommodate various types of recording paper. Correspondingly, the image forming apparatus is also required to accommodate recording paper having poor (small) smoothness at the surface of the recording paper. However, with respect to the recording paper having the low surface smoothness, an image defect called a "see-through" defect can be generated. The "see-through" defect is an image defect that generates a darkness (density) non-uniformity on the image on the recording paper after fixing, and thus can generate a defect as a result of the fixing process.

The generating mechanism of the "see-through" is attributable to a phenomenon that an unfixed toner layer placed on a projected portion of paper fiber on the recording paper surface is subjected to the concentrated application of heat and pressure from a rotatable fixing member compared with that placed on a recessed portion, and thus the toner on the projected paper fiber portion is excessively melted and flows into the recessed portion. As a result, it would be considered that the toner layer at the projected paper fiber portion becomes thin and thus the paper fiber is seen through the toner layer to generate the darkness non-uniformity on the image as described above.

In order to solve such a problem, Japanese Laid-Open Patent Application (JP-A) 2010-54536 discloses a device (method) configured to control the degree of melting of the toner on the recording paper by switching the distribution of pressure at a fixing nip with respect to a recording paper conveyance direction depending on the type of the recording paper. However, in the method described in JP-A 2010-54526, the pressure distribution at the nip with respect to the recording paper conveyance direction is switched, and therefore the pressure at the nip is liable to be fluctuated, and in the case where the pressure fluctuation is intended to be avoided, an increase in size and cost are caused.

Therefore, to prevent the excessive melting of the toner layer located in a lowermost layer side on the recording paper, the inventors ad attention to the manner of applying heat to the toner layer located in the lowermost layer side on the recording paper. Specifically, the temperature of the rotatable pressing member was lowered, so that the heat supply from the rotatable pressing member side to the toner layer located in the lowermost layer side on the recording paper was suppressed. As a result, if the toner image can be fixed on the recording paper while maintaining a volume of the toner layer located in the lowermost layer side to some extent, it becomes possible to form a layer structure having a thickness to some extent by using the lowermost layer as a foundation (base) (hereinafter referred to as a "foundation structure").

On the other hand, when the foundation structure is formed on also the recording paper having good (large) smoothness, there is a possibility that the toner layer located in an uppermost side on the recording paper is melted and spread over the toner layer located in the lowermost layer as the foundation structure to form a smooth surface. Therefore, there is a possibility that a harmful effect, such as uneven glossiness of the image, is generated.

SUMMARY OF THE INVENTION

A principal object of the present invention is to provide a fixing device capable of properly performing a fixing process depending on smoothness of recording paper.

According to an aspect of the present invention, there is provided a fixing device comprising: a rotatable fixing member configured to fix at a nip a toner image formed on recording paper; a rotatable pressing member configured to form the nip between itself and the rotatable fixing member; and a controller configured to control a temperature of the rotatable pressing member depending on smoothness of the recording paper.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
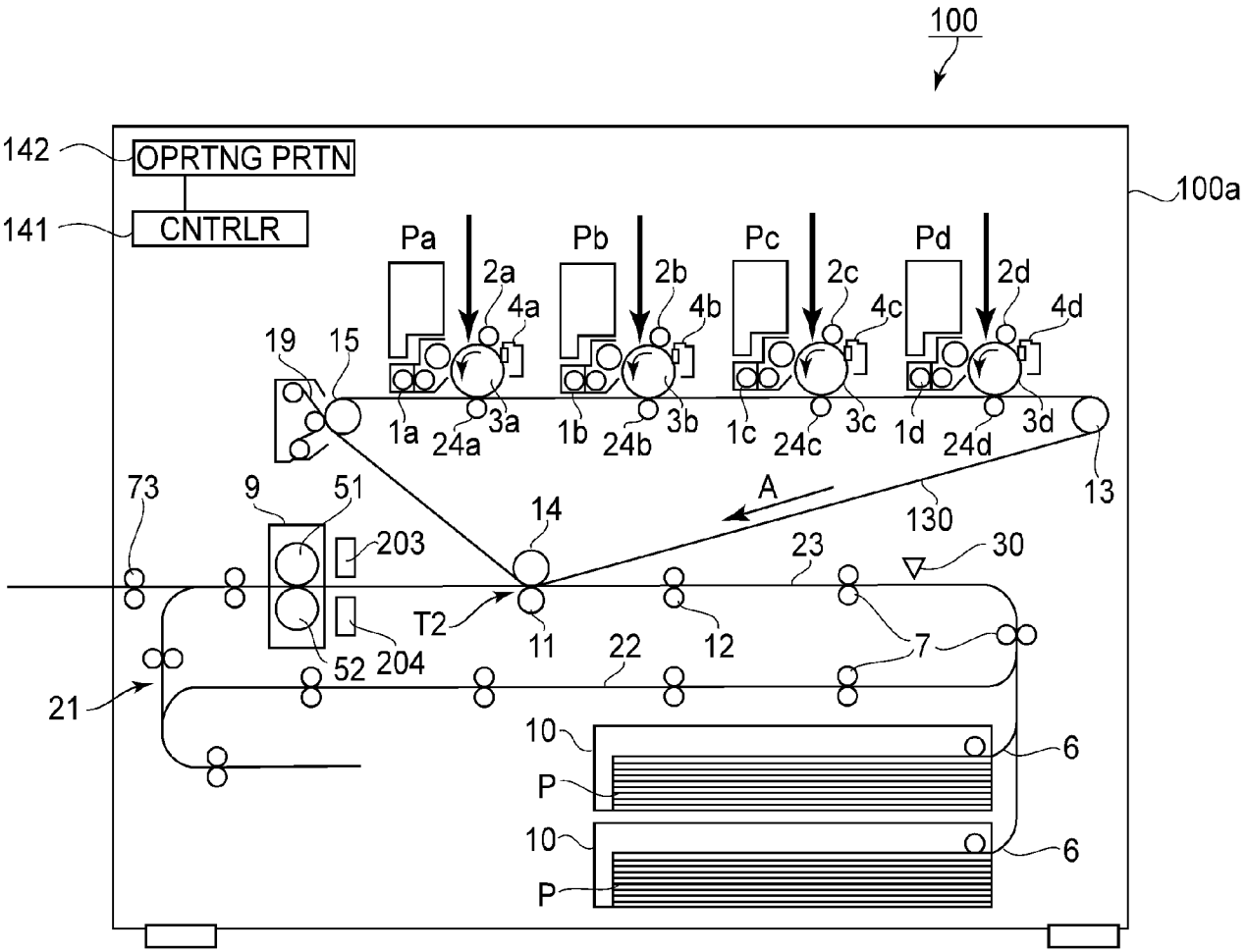
FIG. 1 is a sectional view of an image forming apparatus in an embodiment according to the present invention.

Hereinbelow, embodiments of the present invention will be described with reference to FIGS. 1 to 10. FIG. 1 is a side view showing an example of an image forming apparatus 100 in which a fixing device 9 according to the present invention is mounted. In the following embodiments, the fixing device for fixing an unfixed toner image or recording paper will be described but the present invention is also applicable to a heating apparatus (device) for adjusting a surface property of an image by heating and pressing recording paper on which a fixed image or a partly fixed image is carried.

First Embodiment

The image forming apparatus 100 is a color forming apparatus of an electrophotographic type. As shown in FIG. 1, inside an apparatus main assembly 100*a* of the image forming apparatus 100, first to fourth image forming portions Pa, Pb, Pc and Pd are juxtaposed. At these image forming portions Pa, Pb, Pc and Pd, toner images of different colors (yellow, magenta, cyan and black) are formed through a process including latent image formation, development and transfer.

The image forming portions Pa, Pb, Pc and Pd include dedicated image bearing members, i.e., electrophotographic-type photosensitive drums 3*a*, 3*b*, 3*c* and 3*d*, respectively, in this embodiment, and on each of the drums 3*a*, 3*b*, 3*c* and 3*d*, an associated color toner image is formed. Adjacent to the respective photosensitive drums 3*a*, 3*b*, 3*c* and 3*d*, an intermediary transfer belt 130 is provided.

The respective color toner images formed on the photosensitive drums 3*a*, 3*b*, 3*c* and 3*d* are primary-transferred onto the intermediary transfer belt 130 and then are transferred onto sheet-like recording paper P at a secondary transfer portion T2. Further, the recording paper P on which the toner images are transferred is subjected to fixing of the toner images by the fixing device 9 as an image heating apparatus under heat and pressure and thereafter is discharged to the outside of the apparatus main assembly 100*a* as a recording image-formed product by a sheet discharging portion 73. Incidentally, the image forming portions Pa to Pd and the intermediary transfer belt 130 constitute an image forming portion (station) for forming the toner images (images) on the recording paper. The fixing device 9 fixes on the recording paper the toner images formed on the recording paper by the image forming portion.

At peripheries of the drums 3*a*, 3*b*, 3*c* and 3*d*, drum chargers 2*a*, 2*b*, 2*c* and 2*d*, developing devices 1*a*, 1*b*, 1*c* and 1*d*, primary transfer chargers 24*a*, 24*b*, 24*c* and 24*d* and cleaners 4*a*, 4*b*, 4*c* and 4*d* are provided, respectively. Further, at an upper portion in the apparatus main assembly 100*a*, unshown light source devices, and polygon mirrors and the like are provided.

Laser light emitted from the light source devices are changed to scanning light by rotating polygon mirrors and then fluxes of the scanning light are deflected by reflection mirrors (not shown). Then, the light fluxes are focused on generating lines of the photosensitive drums 3*a* to 3*d* by fθ lenses (not shown) to expose the photosensitive members to light. As a result, so that latent images depending on image signals are formed on the photosensitive drums 3*a* to 3*d*.

In the developing devices 1*a*, 1*b*, 1*c* and 1*d*, as developers, toners of yellow, magenta, cyan and black, respectively, are filled in a predetermined amount by unshown supplying devices. The developing devices 1*a*, 1*b*, 1*c* and 1*d* develop the latent images on the photosensitive drums 3*a*, 3*b*, 3*c* and 3*d*, respectively, to visualize the latent images as a yellow toner image, a magenta toner image, a cyan toner image and a black toner image, respectively.

The intermediary transfer belt 130 is rotationally driven in a direction indicated by an arrow A in FIG. 1 at the substantially same peripheral speed as those of the photosensitive drum 3*a*, 3*b*, 3*c* and 3*d*. In the image forming apparatus 100 in this embodiment, e.g., a process speed can be set at 380 mm/sec.

The yellow toner image for a first color formed and carried on the photosensitive drum 3*a* is intermediary-transferred onto an outer peripheral surface of the intermediary transfer belt 130 by pressure and an electric field formed by a primary transfer bias applied to the intermediary transfer belt 130 in a process in which the yellow toner image passes through a nip between the photosensitive drum 3*a* and the intermediary transfer belt 130.

Then, similarly, the magenta toner image for a second color, the cyan toner image for a third color and the black toner image for a fourth color are successively transferred superposedly onto the intermediary transfer belt 130, so that a synthetic color toner image corresponding to an objective color image is formed.

The secondary transfer portion N2 is constituted by the secondary transfer roller 11 and the intermediary transfer belt 130 which is configured to form the nip between itself and the secondary transfer roller 11 by being urged at its inner surface by a secondary transfer inner roller 14. The secondary transfer roller 11 is shaft-supported in parallel and opposed to the intermediary transfer belt 130 supported at its inner surface by the secondary transfer inner roller 14 and is disposed in contact with a lower surface portion of the intermediary transfer belt 130. To the secondary transfer roller 11, a desired secondary transfer bias is applied by a secondary transfer bias voltage source.

The recording paper P is fed from a sheet feeding cassette 10 by a feeding portion 6 and passes through a recording paper portion 7 such as conveying rollers, a registration roller 12 and a front transfer guide (not shown) to be conveyed into a contact nip between the intermediary transfer belt 130 and the secondary transfer roller 11 with predetermined timing. At the same time, to the intermediary transfer belt 130, the secondary transfer bias is applied from the bias voltage source. As a result, the synthetic color toner image superposedly transferred on the intermediary transfer belt 130 is transferred onto the recording paper P. That is, by this secondary transfer bias, the synthetic color toner image is transferred from the intermediary transfer belt 130 onto the recording paper P. The secondary transfer bias during the toner image transfer onto the recording paper P has an opposite polarity to that of the toner electric charge and is controlled by a controller 141 described later so as to be optimally set depending on an environment (e.g., ambient temperature and humidity of the image forming apparatus) and the type of the recording paper (e.g., basis weight and surface property).

Further, during sheet interval during continuous sheet passing and after a (print) job, cleaning control of the secondary transfer roller 11 is effected, so that a secondary transfer bias of the same polarity as that the toner electric charge is applied to the secondary transfer roller 11 for a predetermined time. As a result, scattering toner and fog toner deposited on the secondary transfer roller 11 are returned to the intermediary transfer belt 130 side, so that a deterioration of a transfer performance and back side contamination of the recording paper, and the like are prevented.

Transfer residual toners on the photosensitive drums 3*a*, 3*b*, 3*c* and 3*d* remaining after the primary transfer is ended are removed from the drums by the cleaners 4*a*, 4*b*, 4*c* and 4*d*, respectively, and then the photosensitive drums 3*a*, 3*b*, 3*c* and 3*d* prepare for subsequent latent image formation. Incidentally, foreign matter, such as the toner and paper powder which remain on the intermediary transfer belt 130, are removed so as to be wiped with a cleaning web (nonwoven fabric) 19 by bringing the cleaning web 19 into contact to the surface of the intermediary transfer belt 130.

In the case of one-side (surface) printing, the recording paper P on which the toner images are transferred at the secondary transfer portion T2 is successively introduced into the fixing device 9 in which the toner images are fixed under application of heat and pressure, and then is discharged as an output product to the outside of the apparatus main assembly 100*a* via the sheet discharging portion 73. On the other hand, in the case of double-side (surface) printing, the recording paper P is conveyed to a reversing unit 21 in which the recording paper P is turned upside down, and then passes through a conveying path 22 for double-side printing and is conveyed again to the conveying path 23. Then, the toner images are transferred onto the back surface of the recording paper P at the secondary transfer portion T2 and are fixed by the fixing device 9, and then the recording paper P is discharged by the sheet discharging portion 73.

As described above, in the image forming apparatus 100, it is possible to effect continuous printing by repeating operations in a sheet feeding step, an image forming step, a transfer step and a sheet discharging step, so that when A4-sized recording paper P is used, it is possible to output the recording paper P at, e.g., 80 sheets per minute.

Figure 2:
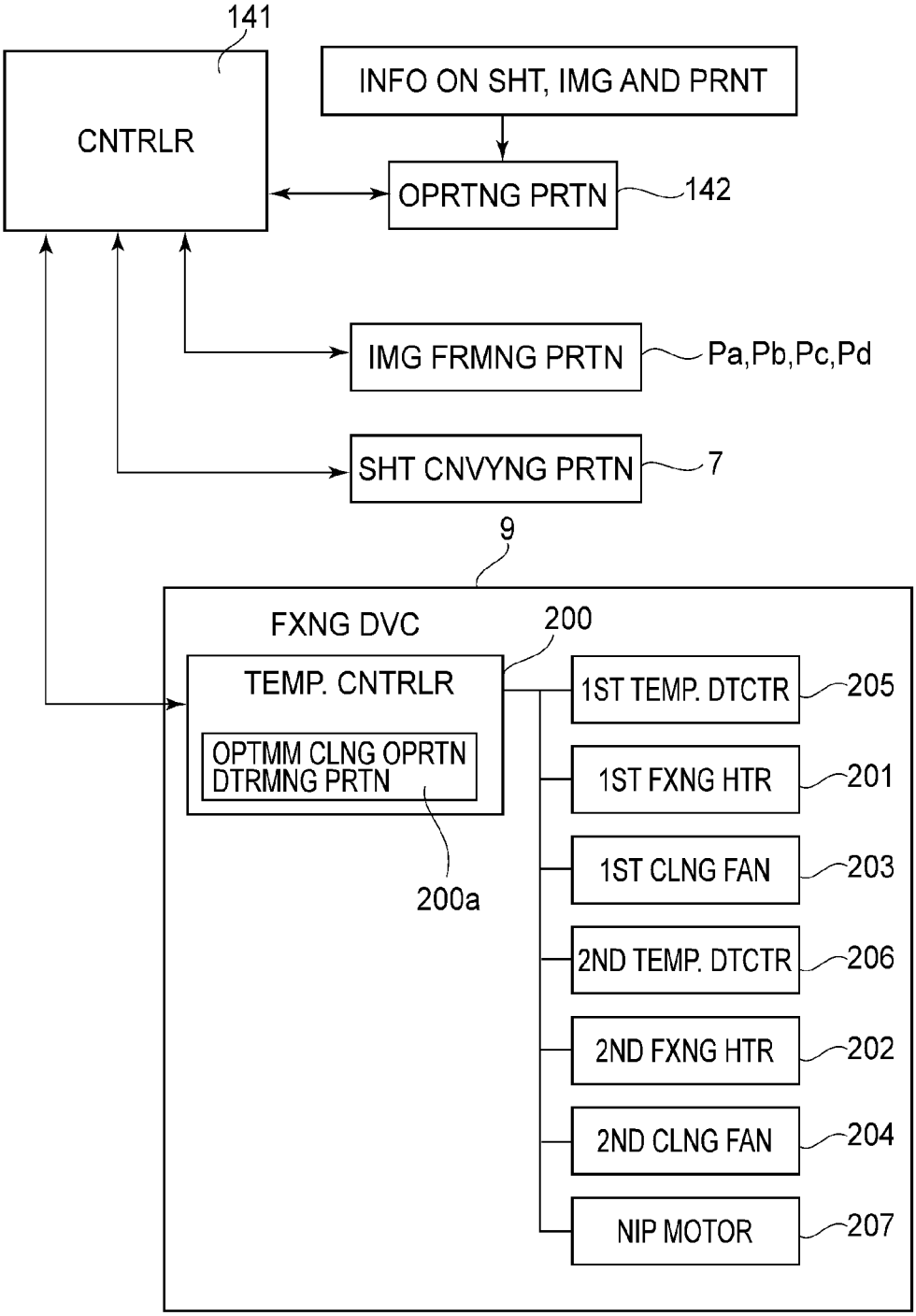
FIG. 2 is a block diagram showing a control system of the image forming apparatus in the embodiment.

In the image forming apparatus 100, as shown in FIGS. 1 and 2, the controller 141, such as CPU and an operating portion 142 as an interface for permitting a user to make access to the image forming apparatus 100, are provided.

The controller 141 orchestrates the operation of the entire image forming apparatus 100 by effecting integrated control of command systems among respective units while monitoring and controlling operations at respective positions in the image forming apparatus 100. The operating portion 142 as a designating portion permits the user to make basic settings of print job information (including recording paper information such as the basis weight, image information such as a density, and print information such as a print number) and detailed settings such as a job for effecting printing by continuously switching the recording paper type, i.e., a so-called "mixed job".

As shown in FIG. 2, to the controller 141, the operating portion 142, the image forming portions Pa to Pd, the recording paper conveying portion 7, the fixing device 9 and the like are connected. The fixing device 9 includes a temperature adjusting controller 200, including an optimum cooling operation determining portion 200*a*, as a controller (control device or means) and includes first fixing heater 201 and a second fixing heater 202, each including a halogen heater or the like as a heating source. The fixing device 9 further includes a first cooling fan 203, a second cooling fan 204, a first temperature detecting member 205, a second temperature detecting member 206 and a nip contact and separation motor 207. The second cooling fan 204 constitutes not only an adjusting means for adjusting a temperature of the pressing roller (rotatable pressing member) 52, but also a cooling means for cooling the pressing roller 52 during actuation.

The temperature adjusting controller 200 as the control device (control means) controls the second cooling fan 204 as a cooling device (cooling means), depending on smoothness (degree of smoothness) of the recording paper. Specifically, the temperature adjusting controller 200 effects switching control of on (actuation state) and off (stop state) of the second cooling fan 204, depending on the smoothness of the recording paper.

Figure 3:
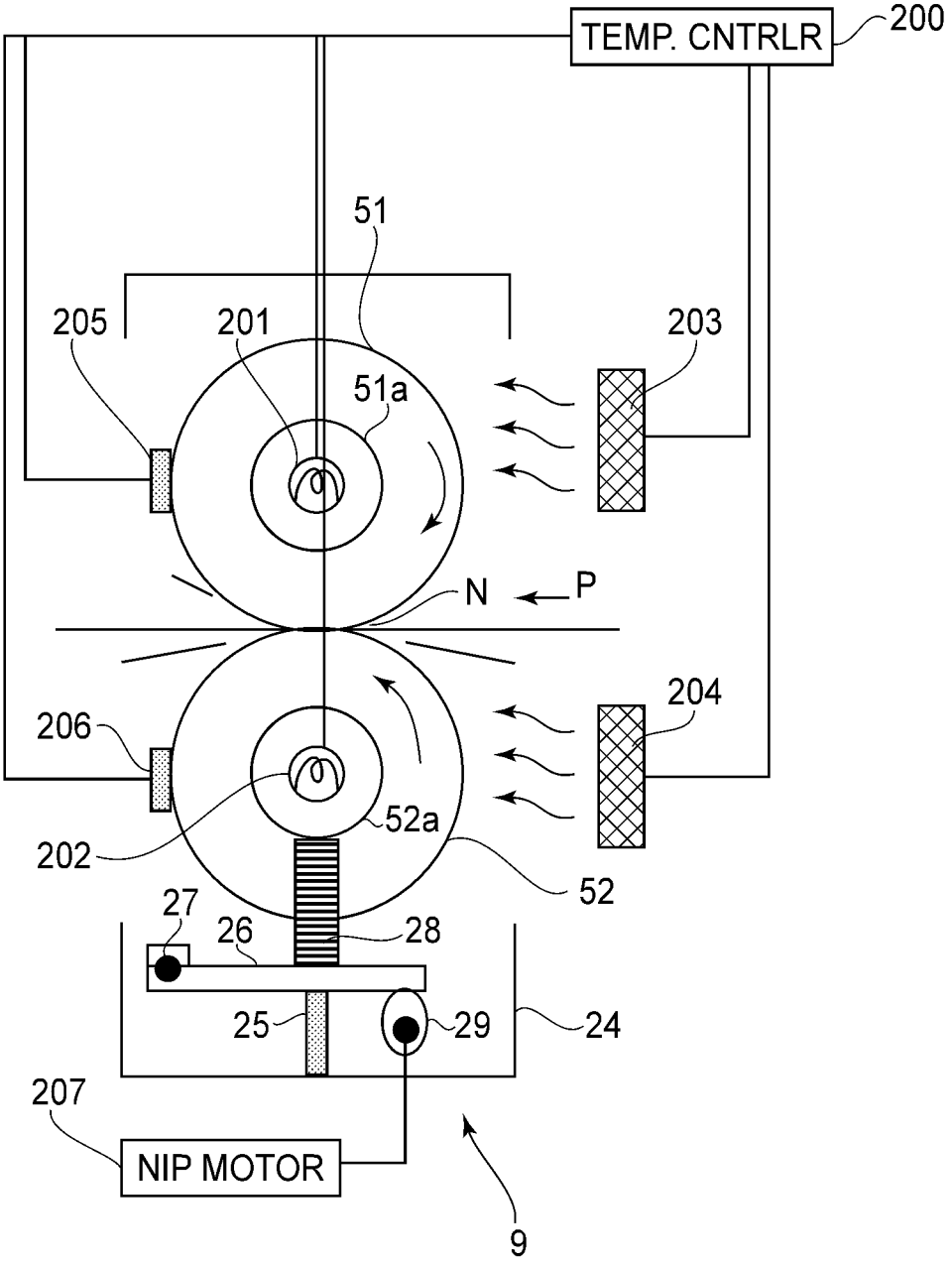
FIGS. 3 and 4 are schematic sectional and plan views, respectively, showing a structure of a fixing device in the embodiment.

Next, a structure of the fixing device 9 in this embodiment will be described with reference to FIGS. 3 and 4. FIG. 3 is a schematic sectional view showing the structure of the fixing device 9 in this embodiment, and FIG. 4 is a schematic plan view showing the structure of the fixing device 9 in this embodiment.

Figure 4:
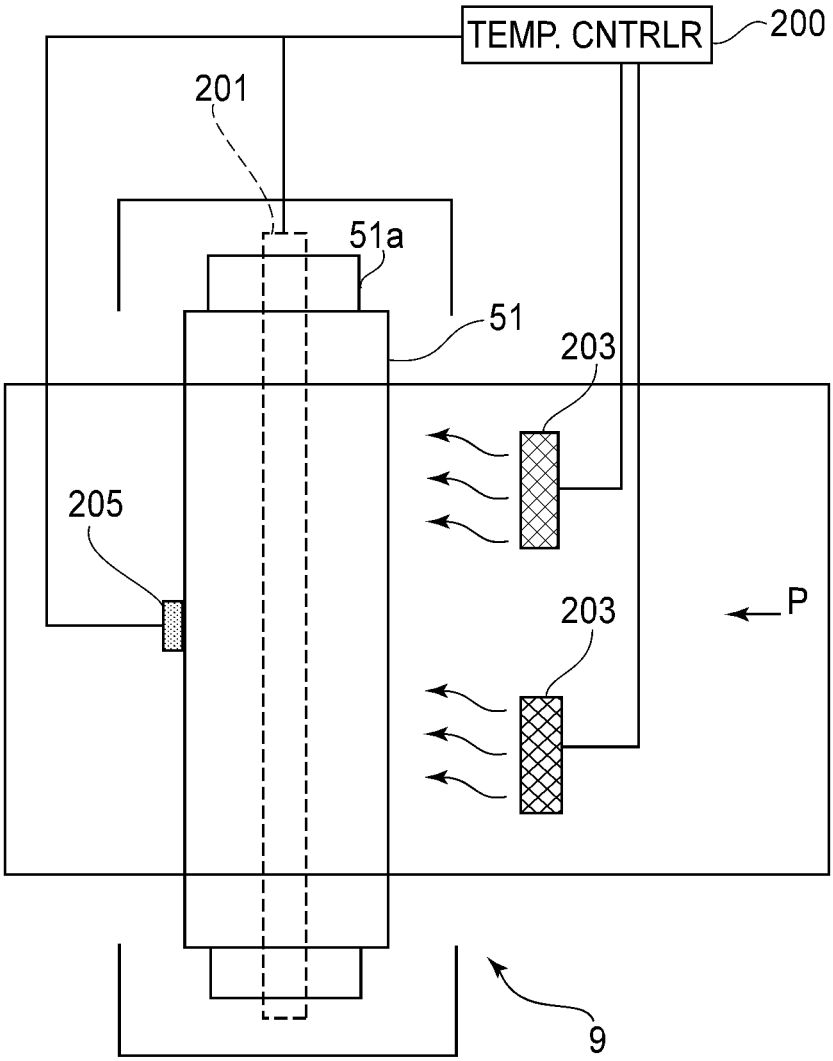

The fixing device 9 includes, as shown in FIGS. 3 and 4, a fixing roller 41 as a rotatable fixing member (image heating member), a pressing roller 52 as a rotatable pressing member (nip forming member) and the nip contact and separation motor 207 for rotationally operating a cam member 29. The fixing device 9 further includes the first and second temperature detecting members 205 and 206 each including a contact-type thermistor or the like, and includes the first cooling fan 203 and the second cooling fan 204. Incidentally, the fixing roller 51 constitutes the image heating member for heating the image formed (transferred) on the recording paper P, and the pressing roller 52 constitutes the pressing member which presses the fixing roller 51 to form a fixing nip N where the recording paper P is to be nip-conveyed.

At a supporting portion 24 of the fixing device 9 in the apparatus main assembly side, an arm member 26 is rotatably supported at its (one) end portion by a supporting shaft 27. At the supporting portion 24, the cam member 29 is rotatably supported, and the arm member 26 contacts the cam member 29 at its other end portion. At a substantially central portion of the arm member 26, a rod-like supporting member 25 slidably penetrates through the arm member 26. An end of the supporting member 25 is extended toward a rotation shaft 52*a* projected at each of end portions of the pressing roller 52, and a compression spring 28 fitted by insertion with the supporting member 25 is contacted to the arm member 26 at one end and is contacted to the rotation shaft 52*a* of the pressing roller 52 at another end.

By the structure, when the cam member 29 is rotationally moved by the driving drive of the nip contact and separation motor 207, on the basis of a predetermined cam shape, the arm member 26 urges or urge-releases (eliminates) the rotation shaft 52*a* of the pressing roller 52 via the compression spring 28. As a result, an urging force of the pressing roller 52 toward the fixing roller 51 is increased and decreased, so that an area of the fixing nip N can be adjusted.

The fixing roller 51 is heated from its inside and contacts the recording paper P in its surface side, and is rotatably supported by a fixed portion (not shown) of the fixing device 9. The fixing roller 51 in this embodiment can, e.g., be constituted by holding a 4 mm-thick layer of an elastic nip of a silicone rubber on a cylindrical metal core of Fe having an outer diameter of 72 mm and by coating the elastic member layer with a 30 μm-thick FPA tube as a parting layer at an outermost portion. The fixing roller 51 is rotationally driven by an unshown driving device, and a rotational speed thereof is controlled.

Inside the fixing roller 51, the first fixing heater 201 as the heating source is provided. The first fixing heater 201 is a heat generating element such as a halogen heater, disposed at the center of the fixing roller 51, and heats an inner surface of the metal core by infrared heating. To the surface (outer peripheral surface) of the fixing roller 51, the first temperature detecting member 205 is contacted, so that a surface temperature of the fixing roller 51 is detected by the first temperature detecting member 205.

The pressing roller 52 is to be disposed in the back side opposite from the surface of the recording paper P where the unfixed toner image is formed and is configured to be rotatable in one direction (arrow direction). The pressing roller 52 is rotatably supported by a fixed portion (not shown) of the apparatus main assembly 100*a* and is disposed so that its rotation shaft 52*a* is parallel to the rotation shaft 51*a* of the fixing roller 51. Inside the pressing roller 52, the second fixing heater 202 as the heating source is provided. To the surface (outer peripheral surface) of the pressing roller 52, the second temperature detecting member 206 is contacted, so that the surface temperature of the pressing roller 52 is detected by the second temperature detecting member 206.

Further, the both end portions of the rotation shaft 52*a* of the pressing roller 52 supported by the fixed portion are urged toward the rotation shaft 51*a* of the fixing roller 51 by the nip contact and separation motor 207 as described above. As a result, the pressing roller 52 is press-contacted to the fixing roller 51 to form the fixing nip N. The pressing roller 52 in this embodiment can be constituted by, for example, holding a 2 mm-thick layer of an elastic member of a silicone rubber on a cylindrical metal core of Fe having an outer diameter of 76 mm and by coating the elastic member layer with a 30 μm-thick PFA tube as a parting layer at an outermost portion. Incidentally, as the first temperature detecting member 205 and the second temperature detecting member 206, e.g., a non-contact thermistor of an infrared detection type can also be used.

The pressing roller 52 may be one including the heating source inside the metal core or one which does not include the heating source, but in this embodiment, the one including the heating source is used. Further, in this embodiment, the roller-type fixing roller 51 is used as the image heating member but as the image heating member, a belt-type image heating member may also be employed when the member can be press-contacted to the pressing roller 52 to form the fixing nip N. This is also true for the pressing member.

That is, in this embodiment, the fixing device 9 was described as the roller-type fixing device including, as the fixing members, the rollers 51 and 52 which are opposed to each other as the image heating member and the pressing member. However, the fixing device 9 may also be constituted by a belt-type fixing device in which either one or both of the fixing members are constituted by an endless belt and the pressing member provided inside the endless belt to form the fixing nip N.

As shown in FIG. 3, the recording paper P is heated and pressed at the fixing nip N when it passes through the fixing nip N from a right side to a left side in the figure, so that the toner image is fixed on the recording paper P. In the fixing device 9 in this embodiment, as described above, as the image heating member and the pressing member for forming the fixing nip N, the fixing roller 51 in an image surface side and the pressing roller 52 in a non-image surface side are used.

Further, voltage supply to each of the first and second fixing heaters 201 and 202 inside the fixing roller 51 and the pressing roller 52, respectively, is controlled by the temperature adjusting controller 200 on the basis of detection of an associated first or second temperature detecting member 205 or 206 contacted to the fixing roller 51 or the pressing roller 52 at a central portion in a roller downstream side. As a result, each of the surface temperatures of the fixing roller 51 and the pressing roller 52 is adjusted.

Further, at the upstream side of the fixing roller 51 from the fixing nip N with respect to a rotation direction of the fixing roller 51, the first cooling fan 203 as a cooling portion for switching temperature adjustment during non-sheet passing is disposed. At the upstream side of the pressing roller 52 from the fixing nip N with respect to a rotational direction of the pressing roller 52, the second cooling fan 204 as a cooling portion for switching temperature adjustment during non-sheet passing is disposed.

The reason why the positions of the first cooling fan 203 and the second cooling fan 204 are located at the upstream sides of the fixing roller 51 and the pressing roller 52 from the fixing nip N with respect to the rotational directions of the fixing roller 51 and the pressing roller 52 is as follows. That is, in the case where the cooling fans 203 and 204 are provided at the downstream side, after the surface of the pressing roller 52 is cooled by the second cooling fan 204, heat accumulated inside the pressing roller 52 is conducted to the surface of the pressing roller 52 to increase the surface temperature until the surface of the pressing roller 52 reaches the fixing nip N. Further, air warmed by the fixing device 9 is blown toward the inside of apparatus main assembly 100*a* to constitute a factor of the inside temperature rise of the image forming apparatus 100.

As shown in FIG. 4, in the fixing device 9 in this embodiment, two first cooling fans 203 are disposed with respect to a longitudinal direction of the fixing device 9 but are constituted so as to be ON/OFF-controlled concurrently by the temperature adjusting controller 200.

In FIG. 4, only the first cooling fans 203 for the fixing roller 51 are illustrated but also with respect to the unshown pressing roller 52 disposed in a rear side of the fixing roller 51 in the figure (i.e., in a lower side of the fixing roller 51, two second cooling fans 204 are disposed with respect to the longitudinal direction. The first cooling fans 203 and 203 for the fixing roller 51 are equidistantly disposed from a center portion of the fixing roller 51 with respect to an axial direction of the fixing roller 51. Further, also the second cooling fans 204 and 204 for the pressing roller 52 are equidistantly disposed from a center portion of the pressing roller 52 with respect to an axial direction of the pressing roller 52.

Incidentally, with respect to the fixing device 9 and the members constituting the fixing device 9, the longitudinal direction means a direction (up-down direction in FIG. 4) perpendicular to the recording paper conveyance direction on a plane of the recording paper P, and a widthwise direction means a direction (left-right direction in FIG. 4) parallel to the recording paper conveyance direction in the plane of the recording paper P. Further, a length means a dimension with respect to the longitudinal direction, and a width means a dimension with respect to the widthwise direction.

In place of the two first cooling fans 203 disposed with respect to the longitudinal direction, e.g., four first cooling fans 203 are disposed with respect to the longitudinal direction and can also be constituted so that the two first cooling fans 203 located at end portions are used for suppressing an end portion temperature rise during small-sized sheet passing. This constitution may also be applicable to the second cooling fans 204, i.e., four second cooling fans 204 are disposed.

The constitution using the four cooling fans for each of the rollers 51 and 52 is employed for avoiding a problem such that the temperature at axial direction end portions of the both rollers 51 and 52 is increased more than at the central portion, where heat is absorbed by the recording paper to cool the rollers, in the case where a narrow-width pressing roller is passed through the fixing nip N, although this temperature increase is not problematic in the case where the recording paper passing through the fixing nip N between the rollers 51 and 52 has a proper size. Therefore, in the case where the four cooling fans are disposed for each of the rollers 51 and 52, by appropriately actuating the cooling fans 203 and 204 by the control at the end portions by the temperature adjusting controller 200, the rollers 51 and 52 are cooled at the end portions where the temperature is liable to be increased, so that proper temperature adjustment can be realized.

Here, the metal core end portions of the fixing roller 51 are rotatably supported, but the pressing roller 52 is constituted so that a contact and separation operation for switching a contact state and a spaced state with respect to the fixing roller 51 can be performed by rotationally driving the shaft of the cam member 29 by the nip contact and separation motor 207 as shown in FIG. 3.

In the fixing device 9 in this embodiment, the fixing nip N having a width of, e.g., about 10 mm can be formed under a total load of about 60 kgf (nearly equal to 588.393 N) during the press contact, and in the spaced state, a distance between the rollers 51 and 52 can be increased to about 2 mm. The nip contact and separation motor 207 was originally intended to realize an improvement in its jam clearance property and the extension of the life of the fixing roller 51, but also performs the following function in this embodiment. That is, the temperature rise of the pressing roller 52 during the non-sheet passing operation is prevented and in addition, in the case where the recording paper having low surface smoothness is selected, the surface temperature of the pressing roller 52 is quickly lowered to a predetermined temperature to minimize a stand-by time until the sheet passing is started.

Figures 5, 6:
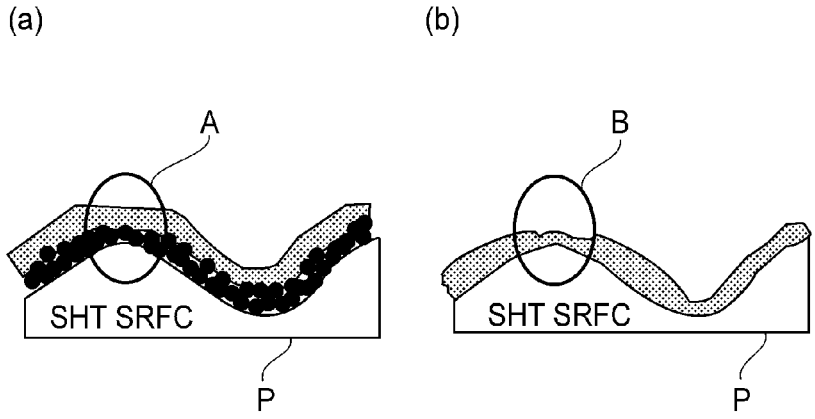
FIG. 5 includes a print target temperature table and a stand-by target temperature table with respect to the fixing device.
FIGS. 6(*a*) and 6(*b*) are schematic views showing foundation structure formation and excessive melting, respectively.

FIG. 5 includes a print target temperature table and a stand-by target temperature table with respect to the fixing device 9 in this embodiment. The temperature adjusting controller 200 in this embodiment effects control on the basis of the print target temperature table and the stand-by target temperature table which are preset.

In the print target temperature table, as the (paper) material, thick paper 2 with a basis weight of 181-256 g/m2, thick paper 1 with the basis weight of 106-180 g/m2, plain paper 2 with the basis weight of 91-105 g/m2, plain paper 1 with the basis weight of 64-90, thin paper with the basis weight of 52-63 and coated paper with the basis weight of 106-180 g/m2 are listed.

The target temperature with respect to the thick paper 2 is 190° C. for the fixing roller 51 and 100° C. for the pressing roller 2, and the target temperature with respect to the thick paper 1 is 185° C. for the fixing roller 51 and 100° C. for the pressing roller 52. The target temperature with respect to the plain paper 2 is 180° C. for the fixing roller 51 and 100° C. for the pressing roller 52, and the target temperature with respect to the plain paper 1 is 175° C. for the fixing roller 51 and 100° C. for the pressing roller 52. The target temperature with respect to the thin paper is 165° C. for the fixing roller 51 and 100° C. for the pressing roller 52, and the target temperature with respect to the coated paper is 170° C. for the fixing roller 51 and 100° C. for the pressing roller 52.

A job start discrimination temperature with respect to the thick paper 2 is 190° C. for the fixing roller 51 and 100-120° C. for the pressing roller 2, and the job start discrimination temperature with respect to the thick paper 1 is 185° C. for the fixing roller 51 and 100-120° C. for the pressing roller 52. The job start discrimination temperature with respect to the plain paper 2 is 180° C. for the fixing roller 51 and 100-120° C. for the pressing roller 52, and the job start discrimination temperature with respect to the plain paper 1 is 175° C. for the fixing roller 51 and 100-120° C. for the pressing roller 52. The job start discrimination temperature with respect to the thin paper is 165° C. for the fixing roller 51 and 100-120° C. for the pressing roller 52, and the job start discrimination temperature with respect to the coated paper is 170° C. for the fixing roller 51 and 100-110° C. for the pressing roller 52.

Further, in the stand-by target temperature table, the target temperature is 180° C. for the fixing roller 51 and 100° C. for the pressing roller 52.

When a print job is started, the controller 141 selects the target temperature on the basis of information on the recording paper P manually set at the operating portion 142 and then effects temperature adjusting control of the fixing roller 51 and the pressing roller 52 via the temperature adjusting controller 200.

The target temperature of the fixing roller 51 is, in order to realize both the conveying property (crease, separating property, etc.) and the image property (fixing property, toner offset, surface glossiness, etc.) described above, set so that it becomes higher with an increasing basis weight, as is understood from FIG. 5. That is, by setting an optimum temperature for the selected material, e.g., by increasing the temperature for the fixing roller 51 with respect to the recording paper P with a large basis weight, the degree of melting of the toner is properly controlled, so that the image property is made good while improving the conveying property.

The target temperature of the pressing roller 52 is basically controlled at 100° C. with respect to all of the materials for the recording paper P in order to eliminate the need for temperature switching, but a temperature range as the job start discrimination temperature for the printing is determined. This is because when continuous sheet passing is effected, due to the presence of sheet intervals, the temperature of the pressing roller 52 is increased by the heat of the fixing roller 51. In the fixing device 9 in this embodiment, the upper limit of the job start discrimination temperature with respect to the non-coated paper is 120° C. for improving the conveying property (crease, separation) and is 110° C. with respect to the coated paper to provide a countermeasure against blisters.

Further, in the image forming apparatus 100 in this embodiment, the stand-by target temperature in default setting is, as described above with reference to FIG. 5, 180° C. for the fixing roller 51 and 100° C. for the pressing roller 52. This is because when print on the plain paper 2 is made, the print can be started without stand-by. When another recording paper is selected as "frequently used recording paper" at the operating portion 142, the stand-by target temperature can be changed.

In the case where the material of the type having low surface smoothness is selected with respect to each recording paper P, as described above, there is a possibility that the image defect due to the "see-through" phenomenon is generated. The see-through (darkness non-uniformity) defect is generated by excessive melting of the toner layer on the projected portion of paper fiber, and therefore in this embodiment, the surface temperature of the pressing roller 52 is made low to suppress the supply of heat from the pressing roller 52 side to a lower portion of the toner layer, thus intending to prevent the excessive melting of the lower portion of the toner layer. This is because when the toner layer lower portion can be melted while retaining a volume to some extent, by the formation of the foundation structure, the generation of the "see-through" defect can be suppressed.

Further, there is a possibility of generation of a problem of improper fixing by suppressing the heat supply from the pressing roller 52 side to the toner layer lower portion, but the fixing property is dominantly influenced by the heat supply from the fixing roller 51, and therefore it may be considered that there is little influence on the fixing property.

FIGS. 6(*a*) and 6(*b*) are schematic views for illustrating the foundation structure formation and the excessive melting in this embodiment. FIG. 6(*a*) shows a state in which the foundation structure is formed on the surface of the recording paper P while preventing the excessive melting of the toner layer lower portion, and FIG. 6(*b*) shows a state in which the melting of the toner layer lower portion has been advanced on the surface of the recording paper P.

When portions of ellipses A and B at the projected portions of paper fiber in FIGS. 6(*a*) and 6(*b*) are noted, at the ellipse A portion, the toner layer lower portion is melted while leaving a volume, and therefore the toner layer thickness is maintained. On the other hand, at the ellipse B portion, the toner layer lower portion is excessively melted, and therefore it is understood that the toner is melted to flow, and thus the toner layer thickness is thin (generation of the see-through defect).

Therefore, as a specific means for suppressing the see-through defect by forming the foundation structure, the surface of the pressing roller 52 is cooled by the pressing roller 52 side cooling fans 204 to the extent that the toner layer lower portion is not excessively melted. A set value of the surface temperature of the pressing roller 52 in this case will be described based on an experimental result below.

Figure 7:
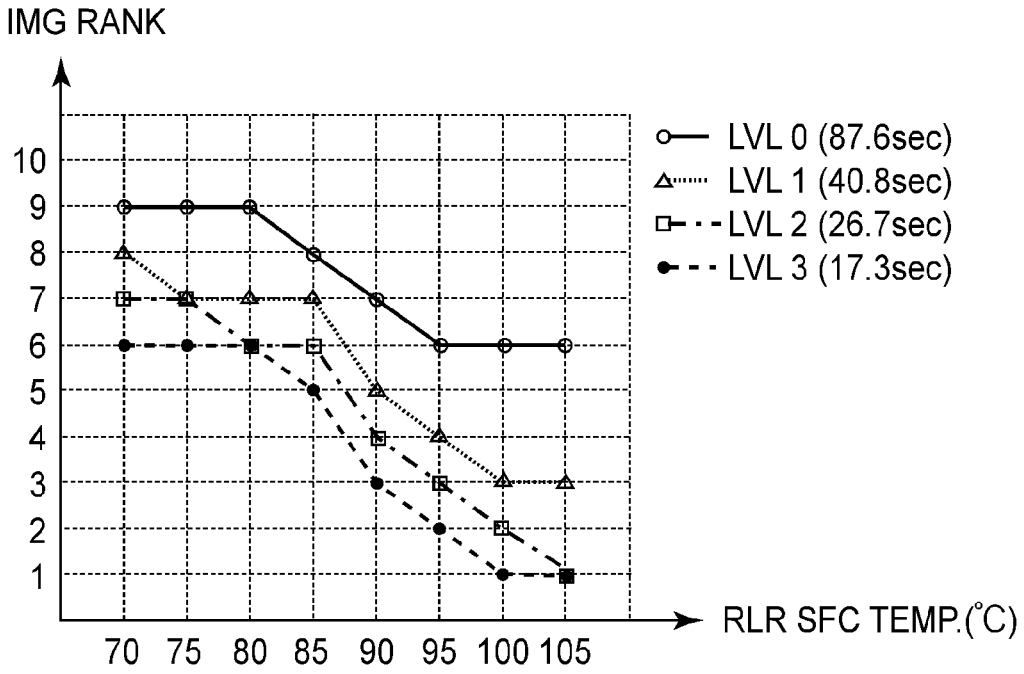
FIG. 7 is a graph showing a correlation between an image rank and a pressing roller surface temperature.

FIG. 7 is a graph showing a correlation between image rank evaluation and the pressing roller surface temperature. FIG. 7 shows the experimental result for determining the target temperature of the surface of the pressing roller 52.

The recording paper used in the experiment was selected after measuring the "Bekk smoothness" of office paper currently used frequently in the market. Specifically, four types including paper type in which the generation of the image defect due to the "see-through" phenomenon is not substantially observed (referred to as see-through level 0 paper) and paper type in which a generation amount of the "see-through" defect is largest (referred to as see-through level 3 paper) were selected from the measured materials. In the following, smoothness refers to the "Bekk smoothness".

Here, a measuring method of the "Bekk smoothness" will be described. The measuring method of the "Bekk smoothness" is one of methods of measuring the smoothness of the recording paper and is classified as an air leakage method. The Bekk smoothness is measured in the following manner. A sheet is sandwiched between a glass-made standard surface subjected to optical flat surface finishing and a pressing plate under pressure of about 98 $kN/m^2$. A time required for air of 10 ml in volume to pass through between the glass-made standard surface of 10 $cm^2$ in area and the rubber-made pressing plate to flow into a vessel kept at a reduced pressure of about 370 mmHg is measured. The measured time (sec) is the Bekk smoothness.

As an evaluation method of the image defect, a proportion of a portion (see-through generation region), where the density is low, to unit area of an image portion was obtained. An image rank evaluation was employed that takes a state in which there is no darkness non-uniformity as a rank 10, and decreases the rank value for every state in which the density is decreased. The image rank evaluation was represented by the ordinate in FIG. 7.

According to the graph of FIG. 7, from the neighborhood of about 80° C., the image rank evaluation is substantially lowered uniformly. From this result, it was found that there is a need to provide the pressing roller 52 with the surface temperature of about 80° C. in order to make the image rank evaluation of "see-through level 3 paper" equal to the image rank evaluation at the pressing roller 52 surface temperature (basic target temperature) of 100° C.

As described above, if the image defect can be prevented by lowering the surface temperature of the pressing roller 52, also a method in which the second cooling fans 204 in the pressing roller 52 side is always operated (actuated) irrespective of the surface smoothness of the recording paper would be considered. However, in that case, when sufficiently smooth recording paper is selected with respect to the surface smoothness of the recording paper on which the generation of the "see-through" is conspicuous, by effecting the above-described control, an adverse effect described below is generated.

Figure 8:
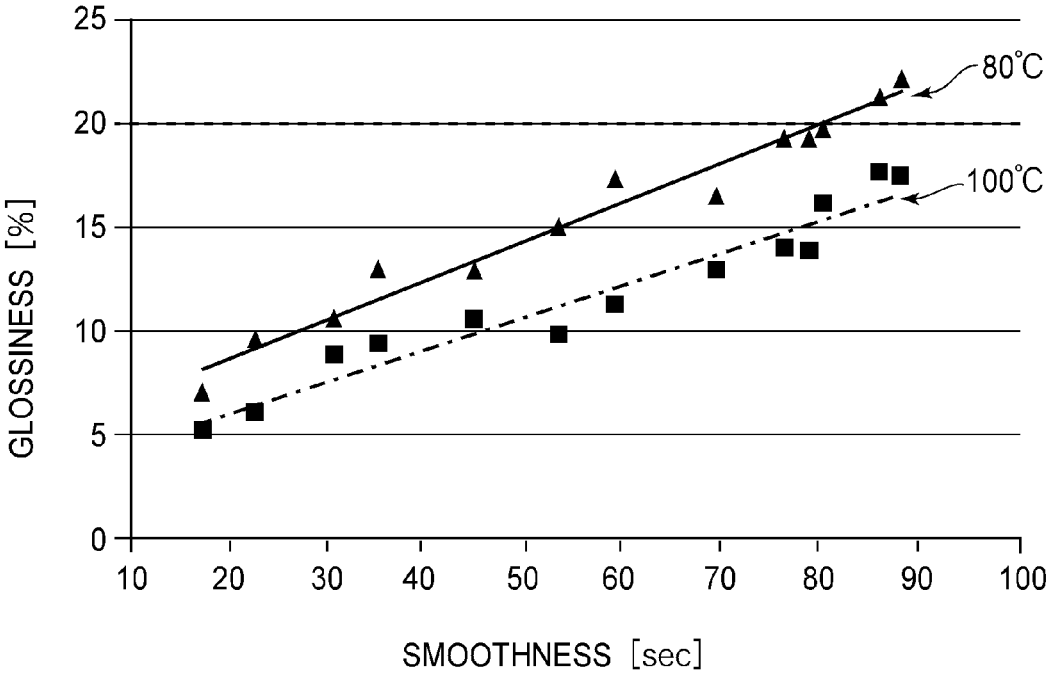
FIG. 8 is a graph showing a correlation between recording paper smoothness and a glossiness value at different pressing roller surface temperatures.

FIG. 8 is a graph showing a correlation between the recording paper smoothness and a glossiness value at different recording paper temperatures. In the graph, a glossiness value (■) of a sample when the image is fixed on the recording paper with each of the surface smoothness values by the pressing roller 52 of 100° C. in surface temperature and a glossiness value (▲) of a sample when the image is fixed on the recording paper by the pressing roller 52 of 80° C. in surface temperature are shown.

The glossiness value was measured by using a handy glossimeter ("PG-1M" mfd. by Nippon Denshoku Industries Co., Ltd.) (according to JIS Z 8741, "Mirror surface glossiness-measuring method"). A measured value of the glossiness value is represented by %. When the glossiness value of the plain paper exceeds 20%, a rate of generation of uneven glossiness due to excessive gloss becomes high.

Although the glossiness value in an image region of the sample after the fixing may desirably be uniform, in the case of the plain paper (recording paper with surface-exposed paper fibers), by projections and recesses of paper fibers, a high-glossiness portion and a low-glossiness portion are locally generated. When the glossiness value of the sample as a whole becomes high, a stepped gloss portion due to the difference in glossiness is visualized and therefore the stepped gloss portion is conspicuous as the image defect. For that reason, the glossiness value is intended to be suppressed to 20% or less.

Therefore, from FIG. 8, the surface of the pressing roller 52 should not be cooled with respect to the recording paper having a smooth surface with the smoothness of 80 sec or more (first surface smoothness) in terms of the Bekk smoothness. Further, it can be understood that in the case of the recording paper with the surface smoothness of less than 80 sec (second surface smoothness), the surface of the pressing roller 52 should be cooled. Therefore, the temperature adjusting controller (executing portion) 200 controls the second cooling fans 204 so as to be switched to an actuated state in the case where the surface smoothness of the recording paper P is less than 80 sec which is a predetermined value.

As described above, only in the case where the recording paper with low surface smoothness less than the predetermined value (recording paper with the second surface smoothness) is selected, there is a need to lower the surface temperature of the pressing roller 52 from the basis target temperature by 20° C. Thus, in this embodiment according to the present invention, with respect to the image defect due to the "see-through" phenomenon on the recording paper with the low surface smoothness, the surface of the pressing roller 52 is cooled to lower the surface temperature, so that the "see-through" defect is suppressed. A specific control method will be described below.

In the specific control method in this First Embodiment, in addition to setting in the print target temperature table in FIG. 5, the following control is added. That is, in the case where a surface-roughening paper mode is selection from the operating portion 142 and this mode (second mode) is selected, the second cooling fans 204 in the pressing roller 52 side are actuated so that the surface temperature of the pressing roller 52 is lowered from the target temperature by 20° C. The actuation will be described by using a flow chart of FIG. 9.

First, in step S1, assuming that the temperature of the fixing device 9 is the stand-by target temperature, the user manually selects the type of the recording paper from the operating portion 142. Then, in step S2, the user discriminates whether or not the surface-roughening paper mode is selected (turned on) depending on the value (high or low) of the surface smoothness, and sets the paper mode at the operating portion 142. Thus, the operating portion 142 constitutes a setting inputting means for manually setting whether or not the control of the surface temperature of the pressing roller 52 by the second cooling fans (adjusting means) 204 is executed.

In the case where the user discriminates that the surface smoothness of the selected recording paper is low and selects the surface-roughening paper mode in step S2, the process goes to step S5. On the other hand, in the case where the user discriminates that the surface of the selected recording paper is sufficiently smooth and does not select the surface-roughening paper mode, the process goes to step S3.

In step S5, the controller 141 turns off (stops) the second fixing heater 202 as the heating source for the pressing roller 52 via the temperature adjusting controller 200 including the optimum cooling operation determining portion 200*a*. Then, in step S6, the temperature adjusting controller 200 based on the controller 141 actuates the first fixing heater 201 as the heating source for the fixing roller 51 to heat the fixing roller 51, and in step S7, actuates the second cooling fans 204 in the pressing roller 52 side.

Continuously in step S8, on the basis of detection of the second temperature detecting member 206, whether or not the surface temperature of the pressing roller 52 is not more than 80° C., which is the predetermined temperature, is discriminated. Then, step S7 is repeated until the surface temperature is not more than 80° C. (predetermined temperature), and at the time when the surface temperature is discriminated as being 80° C. or less, the process goes to step S9. In step S9, the temperature adjusting controller 200 heats the fixing roller 51 (S10), and at the time when it discriminates that the temperature of the fixing roller 51 reaches the target temperature on the basis of detection of the first temperature detecting member 205, the process goes to step S11, in which a print job is started.

On the other hand, in step S3 to which the process goes without selecting the surface-roughening paper mode in step S2, the temperature adjusting controller 200 discriminates whether or not the temperatures of the rollers 51 and 52 reach their target temperatures on the basis of detection of the first and second temperature detecting members 205 and 206 in accordance with the print target temperature table in FIG. 5. In step S3, the temperature adjusting controller 200 detects whether or not the temperature of the fixing roller 51 reaches the target temperature while heating the fixing roller 51 by actuating the first fixing heater 201 or the second fixing heater 202 (S4), and at the time when the controller 200 discriminates that the fixing roller 51 temperature reaches the target temperature, the process goes to S11, in which the print job is started.

As described above, the temperature adjusting controller 200 as the executing portion is constituted so as to be capable of executing operations at least in a first mode (other than the surface-roughening paper mode) and a second mode (surface-roughening paper mode). In the operation in the first mode (other than the surface-roughening paper mode), the image formed on the recording paper with the first surface smoothness (80 sec or more) is heated. In the operation in the second mode (surface-roughening paper mode), the image formed on the recording paper with the second surface smoothness (below 80 sec) lower than the first smoothness by controlling the second cooling fans 204 so that the set temperature is lower than the temperature of the pressing roller 52 in the operation in the first mode.

Figure 10:
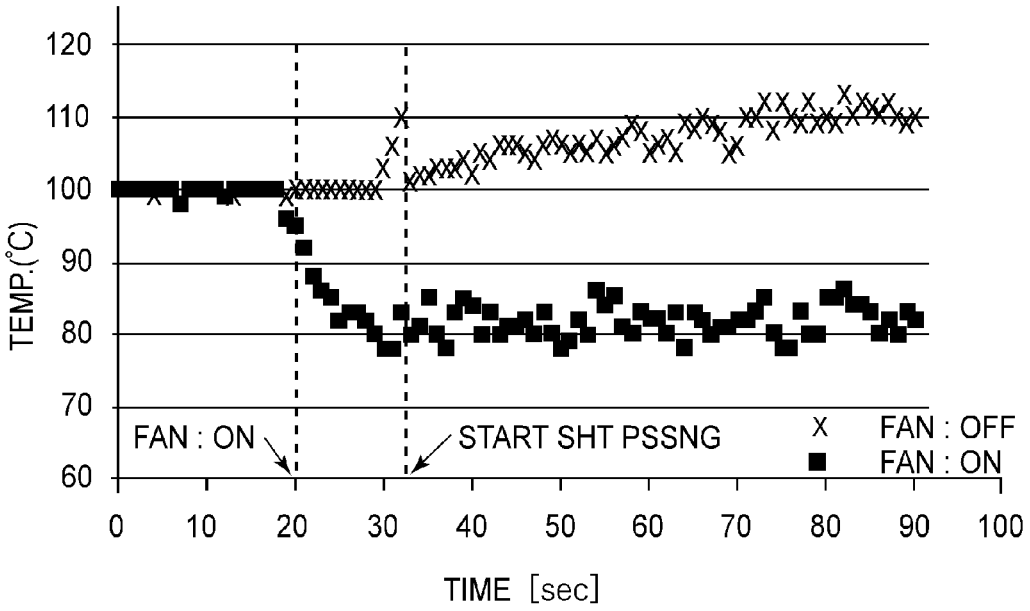
FIG. 10 is a graph showing a result of continuous sheet passing during an operation of a second cooling fan in a recording paper side in the embodiment.

FIG. 10 is a graph of an experimental result when the recording paper ("see-through level 3 paper") in FIG. 7 is actually continuously passed in the above-described sequence. The experimental result will be described below.

In FIG. 10, the ordinate represents the surface temperature (° C.) of the pressing roller 52, and the abscissa represents are elapsed time (sec) of the sequence. In the graph of FIG. 10, a continuous sheet passing result by a conventional basic temperature adjustment and a continuous sheet passing result in the case where the pressing roller 52 is cooled are shown.

In the graph of FIG. 10, when the second cooling fans 204 are actuated at the time the elapse of 20 sec from the start, the surface temperature of the pressing roller 52 was lowered to 80° C. at the time of the elapse of about 10 sec from the actuation. Further, it is understood that the surface temperature of the pressing roller 52 is kept at about 80° C. to about 83° C. by continuously operating the second cooling fans 204 also during the continuous sheet passing.

Further, 10 sample sheets, after the fixing, of the recording paper used in the experiment were randomly extracted from each of a graph of sheets passing through the cooled pressing roller 52 and a graph of sheets passing through the pressing roller 52 which is not cooled, and were subjected to the image rank evaluation. As a result, an average of the image ranks in the case where the pressing roller 52 is not cooled was 1.4 and on the other hand, an average of the image ranks in the case where the pressing roller 52 is cooled was 5.7 which was equivalent to that of the sample, after the fixing, of the recording paper ("see-through level 0 paper") at the basic target temperature.

From the above, by carrying out the present invention, it was possible to keep the surface temperature of the pressing roller 52 at the target temperature also during the sheet passing, so that it was possible to substantiate the suppressing effect of the "see-through" phenomenon with respect to the recording paper with the lower surface smoothness.

As described above, the temperature adjusting controller 200 in this embodiment controls the second cooling fans 204 so that the set temperature is lower than the temperature of the pressing roller 52 in the operation in the first mode. Then, the temperature adjusting controller 200 executes at least the operation in the second mode in which the image formed on the recording paper P with the second surface smoothness lower than the first surface smoothness.

That is, when the recording paper P with the surface smoothness less than the predetermined value is selected, control of cooling the pressing roller 52 by actuating the second cooling fans 204 is effected. As a result, a proper temperature adjusting and cooling sequence is determined so as to keep the surface temperature of the pressing roller 52 at the surface temperature to the extent that the "see-through" defect is not generated also during the sheet passing.

Thus, by selecting an optimum sequence for the cooling control and temperature adjusting control of the pressing roller 52 depending on the surface smoothness of the recording paper P, it is possible to suppress the generation of the image defect due to the "see-through" phenomenon. As a result, also during the continuous sheet passing or the like, in the case where the pressing roller 52 is sufficient low in temperature, even when the recording paper with the high surface smoothness is selected, it is possible to suppress generation of the adverse effect, such as the uneven glossiness or the like, without increasing the pressing roller surface temperature by the heat supply from the fixing roller 51 to the pressing roller 52.

Second Embodiment

Next, Second Embodiment in which the constitution in First Embodiment described above is partly modified will be described by using FIG. 9 common to First and Second Embodiments. In this embodiment, portions common to First and Second Embodiments are represented by the same reference numerals or symbols and will be omitted from description.

Figure 9:
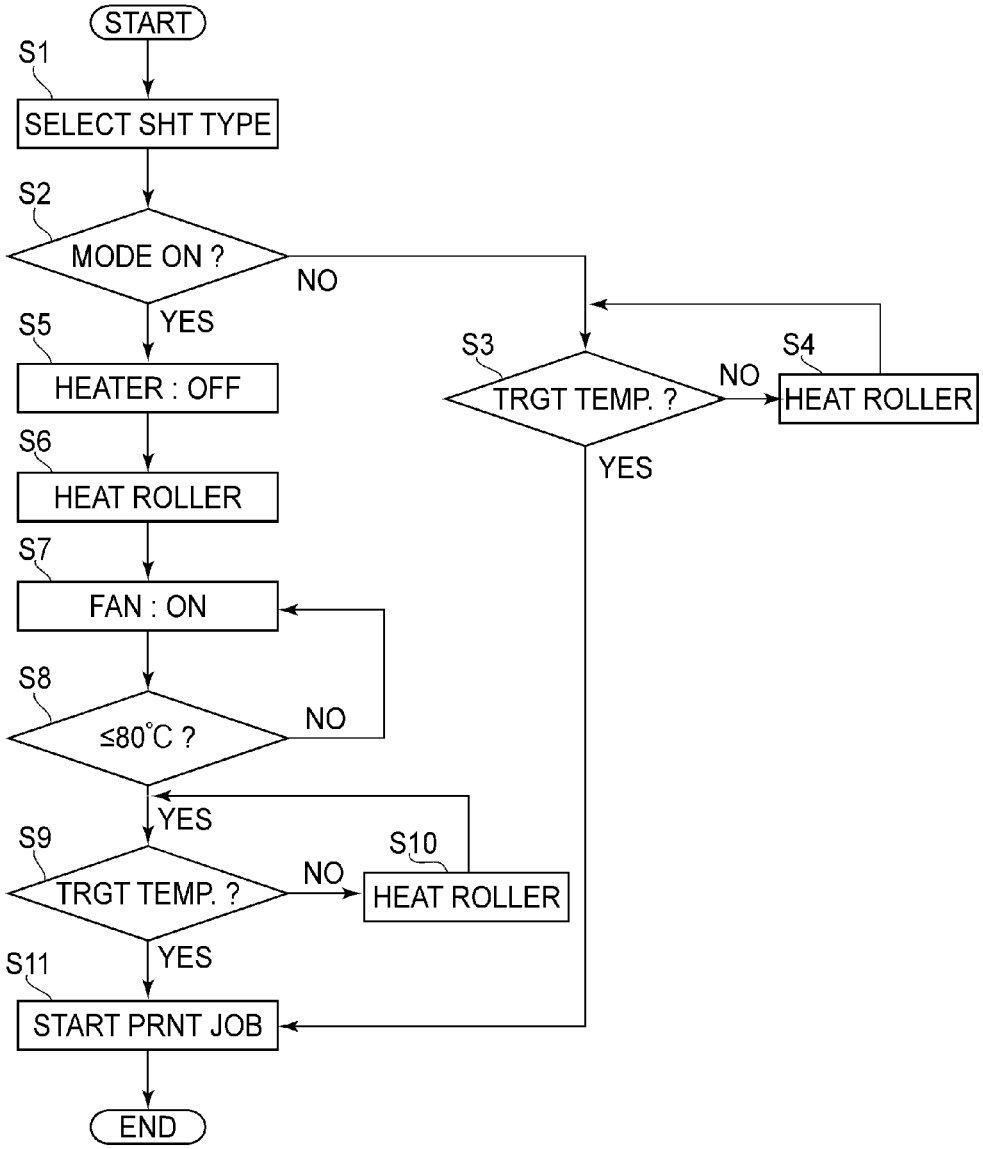
FIG. 9 is a flow chart for illustrating an operation in the embodiment.

In this embodiment, the discriminating process (step S2) as to whether or not the surface-roughening paper mode in the flow chart of FIG. 9 used in First Embodiment is selected (turned on) is constituted so as to be replaced with discrimination on the basis of an automatic measurement result. Process steps other than step S2 in this embodiment are the same as those in First Embodiment.

In First Embodiment described above, the constitution in which the surface smoothness of the selected recording paper is discriminated by the user and then the operation in the surface-roughening paper mode is selected by the manual operation at the operating portion 142 to cool the pressing roller 52 was employed. On the other hand, in this embodiment, a constitution in which the surface smoothness of the recording paper selected by the recording paper type selecting process in step S1 is automatically discriminated in step S2 to discriminate whether or not the pressing roller 52 is cooled is employed.

Specifically, the controller 141 (FIG. 2) measures (detects) the surface smoothness of the recording paper P by an optical sensor 30, as a measuring device (measuring means), provided in the conveying path 23 shown in FIG. 1 at a pre-stage of conveyance of the recording paper P to the secondary transfer portion T2 (FIG. 1). Then, the temperature adjusting controller 200 based on the controller 141 executes the control of the surface temperature of the pressing roller 52 on the basis of the measurement result of the optical sensor 30. That is, the temperature adjusting controller 200 actuates the second cooling fans 204 in the case where the surface smoothness is below 80 sec, in terms of the Bekk smoothness, which is a discrimination reference value (predetermined value), thus performing the cooling of the pressing roller 52. The optical sensor 30 constitutes the measuring means for measuring the surface smoothness (including the first surface smoothness and the second surface smoothness) of the selected recording paper P before the recording paper P reaches the fixing nip N. The second cooling fans 204 are controlled on the basis of the measurement result of the optical sensor 30.

The smoothness measured by the optical sensor 30 is discriminated on the basis of light quantity of reflected light, and the discrimination is made so that the smoothness in high in the case where the reflected light quantity is large and is low in the case where the reflected light quantity is small. The discrimination reference value of below 80 sec is stored in a memory (not shown) of the controller 141 in advance.

In this embodiment, by the above-described sequence, the discrimination of the surface smoothness of the recording paper can be effected with reliability, so that also such an effect of further accurately preventing the generation of the image defect can be obtained.

In First and Second Embodiments, as the image forming apparatus 100, the intermediary transfer color printer of the tandem type, in which the image forming portions Pa to Pd are juxtaposed along the intermediary transfer belt 130, is described as an example, but the present invention is not limited thereto. The image forming apparatus 100 according to the present invention may also be one-drum type intermediary transfer color printer in which color toner images are successively formed on a single image bearing member and then are transferred onto the intermediate transfer member, a tandem type direct transfer color printer in which the intermediary transfer member is not provided and the color toner images are directly transferred from the image bearing members onto the recording paper, and other image forming apparatuses, other than the printers, such as a copying machine, a facsimile machine, and the like.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 281151/2011 filed Dec. 22, 2011, which is hereby incorporated by reference.

What is claimed is:

1. A fixing device comprising:

a rotatable fixing member configured to fix at a nip a toner image formed on recording paper;

a rotatable pressing member configured to form the nip between itself and said rotatable fixing member; and a controller configured to control a set temperature of said rotatable pressing member depending on the smoothness of the recording paper, wherein said controller lowers the set temperature for a first recording paper having a first smoothness to be lower than the set temperature for a second recording paper having a second smoothness which is larger than the first smoothness.

2. A fixing device according to claim 1, further comprising a cooling device configured to cool said rotatable pressing member, wherein said controller actuates controls of an operation of said cooling device in a fixing operation for the first recording paper depending on the smoothness of the recording paper.

3. A fixing device according to claim 2, wherein said cooling device includes a fan configured to blow air toward said rotatable pressing member.

4. A fixing device according to claim 2, wherein said controller does not actuate control of the operation of said cooling device in a fixing operation for the second recording paper depending on the smoothness of the recording paper.

5. A fixing device according to claim 1, wherein the smoothness of the recording paper is the Bekk smoothness.

6. A fixing device according to claim 1, further comprising a designating portion configured to designate a type of the recording paper to be subjected to fixing, wherein said controller controls the set temperature of said rotatable pressing member on the basis of designation by said designating portion.

7. A fixing device according to claim 1, further comprising a measuring device configure to measure the smoothness of the recording paper, wherein said controller controls the set temperature of said rotatable pressing member on the basis of a measurement result of said measuring device.

8. A fixing device according to claim 5, wherein the first smoothness is not larger than the Bekk smoothness of 80 sec., and the second smoothness is equal or larger than the Bekk smoothness of 80 sec.

9. A fixing device according to claim 2, further comprising a detector configured to detect the temperature of said rotatable pressing member, wherein said controller starts the fixing operation for the first recording paper when the detected temperature of said rotatable pressing member reaches a predetermined temperature associated with the rotatable pressing member by a cooling operation of said cooling device.

10. A fixing device according to claim 9, further comprising a heater configured to heat said rotatable heating member and a detector configured to detect the temperature of said rotatable heating member, wherein said controller starts the fixing operation for the first recording paper when the detected temperature of said rotatable pressing member reaches the predetermined temperature associated with the rotatable pressing member and the detected temperature of said rotatable heating member reaches a predetermined temperature associated with the rotatable heating member.

11. A fixing device according to claim 9, further comprising a heater configured to heat said rotatable pressing member, wherein said heater of said rotatable pressing member is not operated during the cooling operation of said cooling device.

12. A fixing device comprising:

a rotatable heating member configured to fix at a nip a toner image formed on recording paper;

a rotatable pressing member configured to form the nip between itself and said rotatable heating member; and a controller configured to control a set temperature of said rotatable pressing member depending on the Bekk smoothness of the recording paper, wherein said controller lowers the set temperature for a first recording paper whose Bekk smoothness is not larger than a predetermined value, to be lower than the set temperature for a second recording paper whose Bekk smoothness is equal or larger than the predetermined value.

13. A fixing device according to claim 12, further comprising a cooling device configured to cool said rotatable pressing member, wherein said controller actuates said cooling device in a fixing operation for the first recording paper.

14. A fixing device according to claim 13, wherein said cooling device includes a fan configured to blow air toward said rotatable pressing member.

15. A fixing device according to claim 13, wherein said controller does not actuate said cooling device in a fixing operation for the second recording paper.

16. A fixing device according to claim 13, further comprising a detector configured to detect the temperature of said rotatable pressing member, wherein said controller starts the fixing operation for the first recording paper when the detected temperature of said rotatable pressing member reaches a predetermined temperature associated with the rotatable pressing member by a cooling operation of said cooling device.

17. A fixing device according to claim 16, further comprising a heater configured to heat said rotatable heating member and a detector configured to detect the temperature of said rotatable heating member, wherein said controller starts the fixing operation for the first recording paper when the detected temperature of said rotatable pressing member reaches the predetermined temperature associated with the rotatable pressing member and the detected temperature of said rotatable heating member reaches a predetermined temperature associated with the rotatable heating member.

18. A fixing device according to claim 16, further comprising a heater configured to heat said rotatable pressing member, wherein said heater of said rotatable pressing member is not operated during the cooling operation of said cooling device.

19. A fixing device according to claim 12, wherein the predetermined value of the Bekk smoothness is 80 sec.

* * * * *